US005737939A

United States Patent [19]

Valence et al.

[11] Patent Number: 5,737,939

[45] Date of Patent: *Apr. 14, 1998

[54] ULTRA LOW TEMPERATURE SPLIT DOOR FREEZER

[75] Inventors: John H. Valence, Williamstown; Keith L. Wharton, Parkersburg, both of W. Va.

[73] Assignee: Forma Scientific, Inc., Marietta, Ohio

[ * ] Notice: The term of this patent shall not extend beyond the expiration date of Pat. No. 5,600,966.

[21] Appl. No.: 798,888

[22] Filed: Feb. 11, 1997

Related U.S. Application Data

[63] Continuation of Ser. No. 455,040, May 19, 1995, Pat. No. 5,600,966.

[51] Int. Cl.[6] ..... F25D 11/02; A47B 96/04

[52] U.S. Cl. ..... 62/441; 312/401; 312/405

[58] Field of Search ..... 62/440, 453, 275, 62/452, 441, 443; 312/401, 402, 403, 404, 405

[56] References Cited

U.S. PATENT DOCUMENTS

| | | | |
|---|---|---|---|
| Re. 20,402 | 6/1937 | Misner | 62/99 |
| 1,630,160 | 5/1927 | Bayless | 62/440 |
| 1,953,836 | 4/1934 | Stevens et al. | 62/441 |
| 2,044,011 | 6/1936 | Nones | 62/441 |
| 2,051,733 | 8/1936 | Moore et al. | 62/441 |
| 2,157,754 | 5/1939 | Gould | 62/453 |
| 2,356,778 | 8/1944 | Morrison | 62/453 |
| 2,495,626 | 1/1950 | Booth | 62/443 |
| 2,987,601 | 6/1961 | Levin | 219/19 |
| 3,042,780 | 7/1962 | Gursahaney | 219/19 |
| 3,052,508 | 9/1962 | Fink | 312/404 |
| 3,495,416 | 2/1970 | Morrissey, Jr. et al. | 62/155 |
| 3,633,374 | 1/1972 | Canter | 62/156 |
| 3,724,129 | 4/1973 | Stromquist | 49/70 |
| 3,726,578 | 4/1973 | Armstrong | 312/214 |
| 3,869,873 | 3/1975 | Thomas | 62/275 |
| 3,939,666 | 2/1976 | Bashark | 62/150 |
| 4,192,149 | 3/1980 | Webb | 62/151 |
| 4,288,135 | 9/1981 | Buchser et al. | 312/296 |
| 4,317,607 | 3/1982 | Gomolka | 312/236 |
| 4,332,142 | 6/1982 | Prada | 62/152 |
| 4,548,049 | 10/1985 | Rajgopal | 62/275 |
| 5,027,615 | 7/1991 | Wakatsuki et al. | 62/419 |
| 5,048,306 | 9/1991 | Wakatsuki et al. | 62/419 |
| 5,056,332 | 10/1991 | Tajima et al. | 62/252 |
| 5,189,888 | 3/1993 | Anderson et al. | 62/248 |
| 5,349,832 | 9/1994 | Johnson et al. | 62/447 |
| 5,600,966 | 2/1997 | Valence et al. | 62/440 |

FOREIGN PATENT DOCUMENTS

| | | | |
|---|---|---|---|
| 763775 | 12/1956 | United Kingdom | 62/440 |

*Primary Examiner*—William Doerrler

*Attorney, Agent, or Firm*—Wood, Herron & Evans, L.L.P.

[57] ABSTRACT

An upright split door, ultra low temperature freezer which includes a single chamber cooled by a cold wall refrigeration system and accessible by separate upper and lower doors. The refrigeration system maintains the chamber at a substantially constant, ultra low temperature, such as within the range of about −50° C. to −90° C. Short term items may be stored in and accessed from an upper portion of the chamber by the upper door without causing the very cold air in the freezer chamber from spilling out the lower portion of the chamber. Long term items may be stored in the lower portion of the chamber and accessed by the lower door. A horizontal mullion is mounted to the freezer side walls and extends between the two doors to provide a seal for respective lower and upper edges of the two doors. A self-regulating heater strip is disposed within the mullion between upper and lower resilient sealing bulbs extending horizontally to prevent condensation build up in the mullion area.

5 Claims, 2 Drawing Sheets

ULTRA LOW TEMPERATURE SPLIT DOOR FREEZER

This is a continuation of application Ser. No. 08/445,040, filed May 19, 1995, now U.S. Pat. No. 5,600,966.

FIELD OF THE INVENTION

The present invention generally relates to ultra low temperature upright freezers which are particularly useful in laboratories and other scientific environments.

BACKGROUND OF THE INVENTION

Several types of upright, ultra low temperature freezers are available, for example, for cooling various scientific products to very low temperatures. One such upright freezer has been available since prior to this invention from Forma Scientific, Inc., located in Marietta, Ohio, under their "8500" and "900" series of freezers. These upright freezers use various controls but each traditionally included a single inner chamber cooled by a surrounding "cold wall" type refrigeration system operated by an ultra low temperature refrigeration unit disposed in the base of the freezer. Evaporation or cooling coils run up and down the side walls and back wall of the freezer as well as through the top and bottom walls. No fans are used for cooling the freezer chamber. Cooling is only accomplished by conduction and convection from the freezer walls into the chamber. A single full length upright door is mounted by hinges in a conventional fashion to the front of the freezer to provide access to the chamber. This particular freezer is capable of cooling the chamber to temperatures within the range of about −50° C. to −86° C.

A problem which has arisen with such ultra low temperature freezers is that when the front door is opened, the extremely cold and heavy air within the chamber tends to spill out of the bottom of the chamber through the front opening of the freezer. Often, these freezers are used for both "long term" and "short term" items which must both be maintained at the same low temperature. Often, short term items must be accessed in a repeated fashion throughout the day and therefore the extremely cold and relatively heavy air, when compared to ambient air, sinks to the bottom of the freezer and spills or falls out the bottom of the front door opening resulting in a substantial loss of cold air every time the door is opened. This not only undesirably increases the temperature of the freezer chamber and its contents, but places increased loads on the refrigeration unit as it must operate on a more continuous basis to account for all of the lost cold air from within the chamber.

It would therefore be desirable to provide an ultra low temperature freezer which allowed ready access to both long term and short term items maintained therein at the same temperature but which prevents spillage of cold air from the bottom of the chamber when short term items are repeatedly accessed.

SUMMARY OF THE INVENTION

It has therefore been an object of the present invention to provide an upright split door, ultra low temperature freezer which includes a single chamber cooled by a cold wall refrigeration system. The refrigeration system maintains the chamber at a uniform or substantially uniform, ultra low temperature, such as within the range of about −50° C. to −90° C. In accordance with the invention, the uniformly cooled chamber is accessed by separate upper and lower doors such that the upper door may be repeatedly opened for exposing an upper portion of the chamber and accessing short term items and the lower door may be maintained closed to prevent the spillage of cold air until long term items disposed in the bottom of the chamber must be accessed. A horizontal mullion is mounted to the freezer side walls and extends between the two doors to provide a seal for respective lower and upper edges of the two doors. A self-regulating heater strip is disposed within the mullion between upper and lower resilient sealing bulbs extending horizontally. This heater strip will raise the temperature of the mullion area above the dew point to prevent condensation from building up in this area. The heater strip is self-regulating in that its temperature will increase as ambient temperature decreases and vice versa.

The ultra low temperature upright freezer of this invention will therefore have two front access openings to the same chamber which is cooled to a substantially uniform ultra low temperature. The ultra low temperature upright freezer of this invention will be used by storing short term, often-accessed items in the upper portion of the freezer chamber which may be accessed by the upper door and storing long term items in the lower portion of the chamber which may be accessed by the lower door. The upper door may be repeatedly opened and closed to access the short term items therein without having the significant amount of cold air "spilling" from the bottom of the freezer, as in the conventional upright freezer, because the lower door will remain closed. The lower door, of course, may also be opened and closed to access the long term items within the lower portion of the chamber. However, as these are "long term" items and are not often accessed, the load on the refrigeration unit will not be taxed nearly as often as with conventional single door upright, ultra low temperature freezers. As a result of the present invention, the upright, ultra low temperature freezer will require less energy to run, will require less maintenance and may operate over a longer useful life than conventional upright, ultra low temperature freezers.

These and other objectives and advantages of the present invention will become more readily apparent to those of ordinary skill in the art upon further review of the following detailed description of the preferred embodiment taken in conjunction with the accompanying drawings.

DETAILED DESCRIPTION OF THE PREFERRED EMBODIMENT

Figure 1:
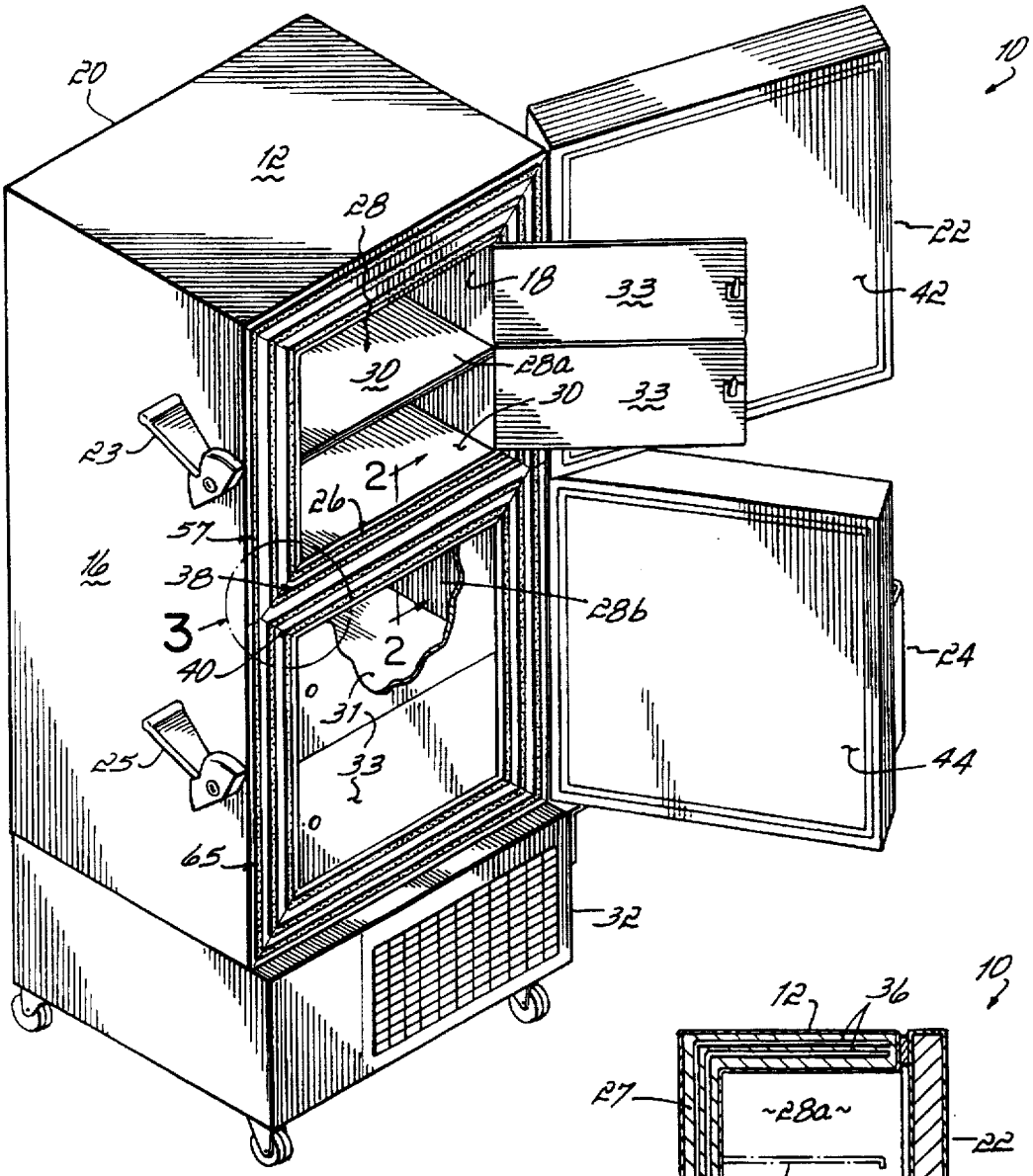
FIG. 1 is a perspective view of an upright, ultra low temperature freezer constructed in accordance with the present invention.
Figure 1A:
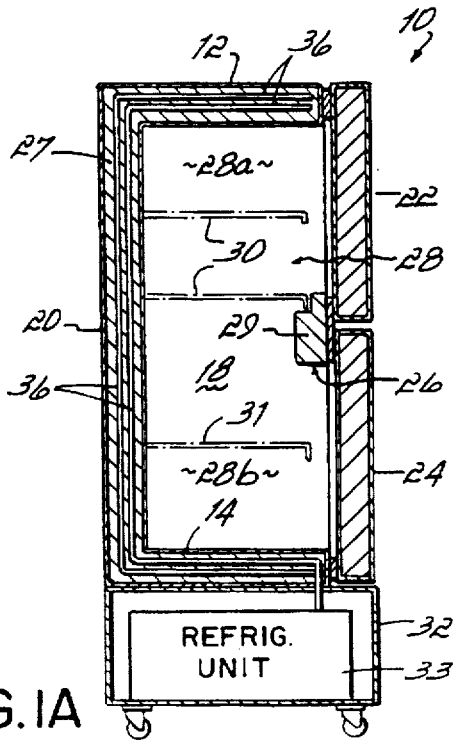
FIG. 1A is a schematic cross-sectional view generally taken along line 1A—1A of FIG. 1 but showing the doors of the freezer in closed positions.
Figure 2:
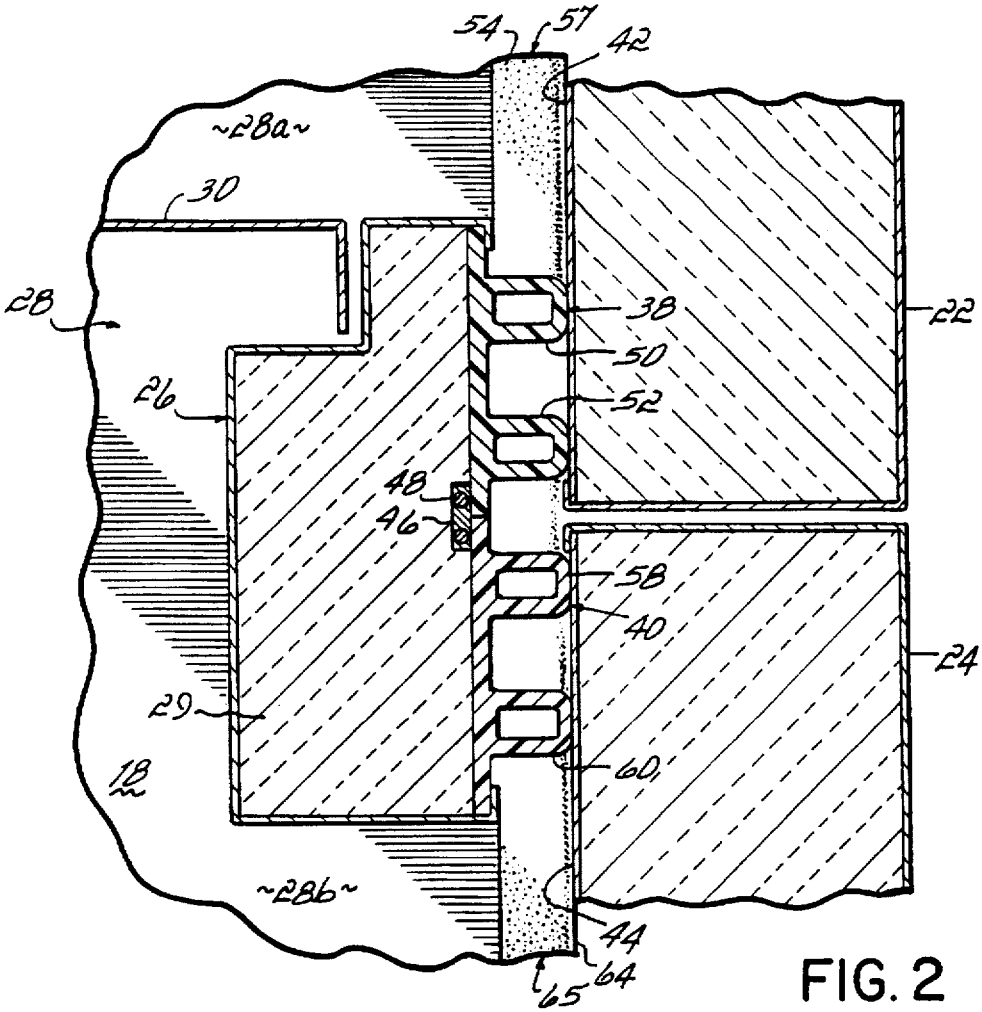
FIG. 2 is a cross-sectional view of the mullion taken along line 2—2 of FIG. 1; and, FIG. 3 is an enlarged front view of the mullion and peripheral gasket area taken from encircled portion 3 of FIG. 1.

Referring first to FIGS. 1 and 1A, an upright, ultra low temperature freezer 10 is shown and is generally formed by an insulated upper wall 12, an insulated bottom wall 14, a pair of insulated side walls 16, 18 and an insulated rear wall 20. Upper and lower insulated freezer doors 22, 24 are hingedly mounted to side wall 18 and seal against front edges of top wall 12, bottom wall 14, side walls 16, 18 and a mullion 26, as will be described. As shown in FIG. 1, mullion 16 is mounted between side walls 16, 18 and extending horizontally between upper and lower doors 22, 24. Walls, 12, 14, 16, 18 and 20 as well as doors 22, 24 preferably have four inch thick polyurethane foam insulation 27 while mullion 26 preferably has two inch thick polyurethane foam insulation 29 (FIG. 2). Doors, 22, 24 have conventional latching handles 23, 25.

Still referring to FIGS. 1 and 2, an inner chamber or freezer compartment 28 is formed by the various walls 12, 14, 16, 18, 20 of freezer 10 and may be accessed and sealed by doors 22, 24 closing against top wall 12, bottom wall 14, side walls 16, 18 and central mullion 26. A plurality of shelves 30 are preferably provided within an upper portion 28*a* of freezer chamber or compartment 28 for holding various short term items and a shelf or shelves 31 may be provided in a lower portion 28*b* of freezer chamber or compartment 28 for holding various long term storage items. As further shown in FIG. 1, upper and lower portions 28*a* and 28*b* of freezer chamber or compartment 28 may be partitioned off by doors 33.

As shown in FIG. 1A, upright, ultra low temperature freezer 10 further includes a base 32 holding a refrigeration unit 34 which may be comprised of conventional low temperature refrigeration components, such as a compressor, condenser, expansion device, and evaporator unit. In a known manner, refrigeration unit 34 does not rely on fans to cool freezer chamber or compartment 28 but instead relies on evaporator coils 36, which may comprise copper tubing, extending from refrigeration unit 34 within base 32 into the various walls of freezer 10. Preferably, coils 36 extend within each of the top, bottom, side and rear walls 12, 14, 16, 18, 20 of freezer 10 and thereby serve to efficiently and uniformly cool chamber or compartment 28 by conduction and convection only. The refrigeration unit and coil configuration may be the same as used in the above-mentioned "8500" and "900" series of upright freezers available from Forma Scientific, Inc., located in Marietta, Ohio.

Figure 3:
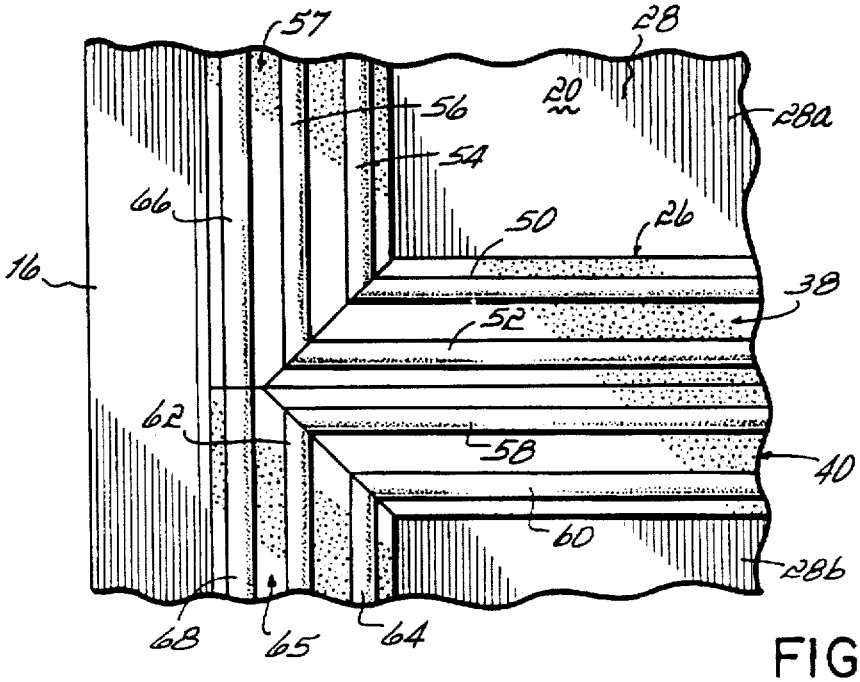

Referring now to FIGS. 2 and 3, central mullion 26 includes a pair of upper and lower two-bulb gaskets 38, 40 which provide a seal against the respective inner surfaces 42, 44 of upper and lower doors 22, 24. Central mullion 26 further includes a self-regulating heating strip 46 extending horizontally and generally along an outer surface thereof between the upper and lower pairs of two-bulb gaskets 38, 40 for preventing condensation build-up in the mullion area. Heater strip 46 includes a resistance-type heating element 48 which is regulated such that the wattage supplied thereto and therefore the heat which it supplies to the mullion area is increased as ambient temperature decreases and vice versa. The preferred heater strip 46 may be obtained from Raychem Company under Part No. H611050 for the 115 V version and under Part No. H621050 for the 220 V version.

FIG. 3 illustrates the junction between mullion 26 and side wall 16. In this regard, resilient bulbs 50, 52 of two-bulb gasket 38 align with resilient bulbs 54, 56 of three-bulb gasket 57 extending along the front edge of side wall 16. Likewise, bulbs 58, 60 of two-bulb gasket 40 align with respective inner bulbs 62, 64 of three-bulb gasket 65 also extending along the front edge of side wall 16. Respective third outside bulbs 66, 68 of three-bulb gaskets 57, 65 align as shown to complete the three-bulb seal at the junction of side wall 16 and mullion 26. It will be appreciated that a three-bulb seal is provided around the entire front periphery of freezer 10 as shown in FIG. 1. Also, as the junction between mullion 26 and side wall 18 is the same as the corresponding junction shown in FIG. 3, description thereof is not necessary.

From the foregoing description, it will be appreciated that upright freezer 10 may be used to efficiently cool scientific or other products down to temperatures in the range of −50° C. to −90° C. in a substantially uniformly cooled freezer chamber or compartment, and access may be made to the upper portion of this compartment without causing the substantial loss of this extremely cold air from the bottom of the compartment as would normally be the case with a conventional upright, ultra low temperature freezer. Furthermore, the present invention achieves this objective while still inhibiting the undesirable build-up of condensation.

While a preferred embodiment of this invention has been detailed herein, it will be appreciated that further modifications and substitutions of these details may be made without departing from the spirit and scope of the invention. Therefore, Applicants do not intend to be bound to the disclosed details, but only by the scope of the appended claims.

What is claimed is:

1. An upright freezer comprising:

a freezer chamber having upper and lower chamber portions separated by a solid divider and contained by insulated peripheral walls including a pair of side walls, a top wall, a bottom wall and a rear wall;

a mullion extending between said pair of side walls and between said upper and lower chamber portions;

an upper insulated door and a lower insulated door hingedly secured to one of said side walls and having respective lower and upper edges thereof sealing against said mullion when in closed positions; and, a refrigeration unit connected to said freezer which cools said chamber to a substantially uniform temperature below about −50° C.

2. The upright freezer of claim 1 wherein said solid divider is disposed behind said mullion and physically separates air in said upper chamber portion from air in said lower chamber portion.

3. The upright freezer of claim 2 further including additional shelves within the upper and lower chamber portions.

4. The upright freezer of claim 2 further including a plurality of doors for partitioning off the upper and lower chamber portions and disposed interiorly with respect to said upper and lower insulated doors.

5. The upright freezer of claim 1 wherein said refrigeration unit includes evaporator coils contained within peripheral walls of said chamber.

* * * * *